US006971198B2

(12) United States Patent
Venegas, Jr.

(10) Patent No.: US 6,971,198 B2
(45) Date of Patent: Dec. 6, 2005

(54) BARRIER COVER

(76) Inventor: Frank Venegas, Jr., 5682 Lake Ridge Dr., Brighton, MI (US) 48116

( * ) Notice: Subject to any disclaimer, the term of this patent is extended or adjusted under 35 U.S.C. 154(b) by 0 days.

(21) Appl. No.: 10/782,013

(22) Filed: Feb. 19, 2004

(65) Prior Publication Data

US 2004/0164284 A1 Aug. 26, 2004

Related U.S. Application Data

(63) Continuation of application No. 09/779,782, filed on Feb. 8, 2001.

(51) Int. Cl.[7] ..... G09F 15/00

(52) U.S. Cl. ..... 40/607.01; 40/607.03; 40/607.05; 40/607.11; 40/606.18; 40/600

(58) Field of Search ..... 40/607.01, 607.03, 40/607.05, 607.11, 606.01, 606.18, 611.01, 40/600

(56) References Cited

U.S. PATENT DOCUMENTS

| | | | | |
|---|---|---|---|---|
| 1,186,073 | A * | 6/1916 | Brown et al. | 224/42.13 |
| 1,724,281 | A * | 8/1929 | Halthorn | 40/579 |
| 2,678,707 | A | 5/1954 | Finkelstein | 190/57 |
| 3,307,282 | A * | 3/1967 | Caulkins | 40/587 |
| 3,870,360 | A * | 3/1975 | Nichols | 296/37.3 |
| 3,874,103 | A | 4/1975 | Mutra | 40/600 |
| 4,438,848 | A | 3/1984 | Montealegre et al. | 362/267 |
| 4,960,302 | A | 10/1990 | Walters | 296/100 |
| 5,105,347 | A | 4/1992 | Ruud et al. | 362/268 |
| 5,228,608 | A * | 7/1993 | Stout, III | 224/42.13 |
| 5,323,583 | A | 6/1994 | Venegas, Jr. | 52/727 |
| 5,438,950 | A | 8/1995 | Rodrigues | 116/222 |
| 5,551,578 | A | 9/1996 | McCue et al. | 211/17 |
| 5,605,414 | A * | 2/1997 | Fuller et al. | 40/607.11 |
| 5,815,965 | A | 10/1998 | de Greeve | 40/209 |
| 5,967,214 | A | 10/1999 | Beretta | 160/135 |
| 6,061,939 | A * | 5/2000 | Gildea | 40/538 |
| D427,242 | S * | 6/2000 | Pettesch | D20/10 |
| 6,159,577 | A * | 12/2000 | Pynenburg et al. | 428/99 |
| 6,263,601 | B1 | 7/2001 | Emert | 40/564 |
| 6,263,691 | B1 | 7/2001 | Ueno et al. | 62/292 |
| 6,339,866 | B1 * | 1/2002 | French | 24/306 |

* cited by examiner

*Primary Examiner*—Gary C. Hoge
(74) *Attorney, Agent, or Firm*—Gifford, Krass, Groh, Sprinkle, Anderson & Citkowski, PC

(57) ABSTRACT

A post cover with advertising for use with a substantially semi-circular guard post of the type commonly found surrounding fuel pumps at gasoline stations. The post cover has a substantially semi-circular shape with an interior cavity dimensioned to receive a generally semi-circular guard post in slip fit engagement. The cover is generally molded of a resilient, durable, low maintenance and exposure resistant structural plastic that can be treated during the molding process with coloring agents and chemical additives to enhance its esthetic and resiliency character respectively.

9 Claims, 1 Drawing Sheet

BARRIER COVER

REFERENCE TO RELATED APPLICATION

This application is a continuation of U.S. patent application Ser. No. 09/779,782, filed Feb. 8, 2001, the entire content of which is incorporated herein by reference.

FIELD OF THE INVENTION

The present invention generally relates to protective barrier covers and, more specifically, to covers for particularized support structures.

BACKGROUND OF THE INVENTION

Guard post or protective stanchions are commonly found in industrial settings, parking lot structures, and around drive-thru lanes at fast food restaurants. These structures typically provide a protective barrier for building structures or pedestrian walkways for the purpose of preventing damage or injury that could occur in a vehicular collision. Typically, guard posts are formed of an elongated tubular steel exterior with a core of concrete.

As commonly seen in construction, a guard post, having two opposite ends, will have one end embedded in a fixed surface while the opposite end extends outwardly from the fixed surface to about three to four feet. In most instances, the exterior surface of the guard posts is painted to protect against corrosion due to environmental exposure. Additionally, painting a post with certain colors can aid with improving its visibility in dimly light conditions.

Despite the advantages that painting provides, prolonged exposure to the environment can still cause unsightly surface corrosion and a need for labor-intensive repetitive maintenance. Over time, the cost associated with maintaining the esthetic appearance of these posts can become substantial. Recognizing the desire to minimize the issues that stem from maintaining the appearance of these posts, the present inventor has created special covers for guard posts that maintain an esthetic appearance while practically eliminating the need for repetitive maintenance.

Commonly assigned U.S. Pat. No. 5,323,583 describes a protective sleeve to be used with stanchions or guard posts. The patent discloses an elongated tubular sleeve, made of a durable and resilient plastic material that can be easily fitted over a guard post by receiving it into its interior cavity. The sleeves can be manufactured in many colors to improve visibility and the material can be treated with chemicals to resist ultra-violet deterioration.

The problems associated with maintenance for the most common type of guard post described above are disclosed in U.S. Pat. No. 5,323,583, but the product is not intended for use with other types of posts, particularly the type commonly found surrounding fuel pumps at gasoline stations.

These posts are typically formed of the same materials, tubular steel with a concrete core, but the shape and construction is vastly different. Generally, these guard posts are of a substantially semi-circular or arch-like shape having its two opposite ends embedded in a fixed surface adjacent to the fuel pump. As described above, painting is used to maintain esthetic appearance and improve visibility of these guard posts. Consequently, the same maintenance problems occur due to prolonged environmental exposure.

SUMMARY OF THE INVENTION

The present invention discloses a low maintenance protective cover for use with a substantially semi-circular or arching guard post. Additionally, the cover preferably supports an advertising display for displaying an advertisement, logo, or message.

Typically, the arching barrier posts are formed of elongated tubular steel body having a hollow or concrete core that extends substantially semi-circularly between its two opposite ends resulting in these ends and portions of the tubular body, that will subsequently be referred to as legs, being adjacent and separated by a fixed distance with an arching portion bridging the distance between the two legs. In construction, the post has its opposite ends and a substantial portion of the tubular body embedded in a fixed surface while the vertex of the arch extends outwardly from the fixed surface.

The body of the post is typically 6 to 8 inches in diameter, although it is recognized that other configurations may have a diameter greater or less for an intended use. The linear distance that separates substantial portions of the legs of the substantially semi-circular tubular steel body and the two opposite ends is on the order of 50 inches, although, again, other embodiments may command a distance greater or less for an intended use.

In a preferred embodiment, the cover is dimensioned to receive the barrier post in slip-fit engagement and adapted to support an advertising display such as a message of stenciled letters, an electrical/electronic circuit comprising one or more lighting elements configured to display a message or image, one or more magnetically mounted objects of a ferro-magnetic material supported on metallic surface, Velcro materials, peg boards, a chalkboard surface, or combinations thereof.

The lighting elements in the cover assembly may be supported by either an internal or external power supply, and the cover assembly may further include an electronic circuit composed of components necessary for power control and management. Preferably, for security purposes, the cover may include a fastening means for securing it to the fixed surface, such as L brackets and screws or other suitable fastening means.

These and other features and benefits of the invention will be recognized by those skilled in the art, from the specification, the claims that follow, and the attached drawings.

DETAILED DESCRIPTION OF THE DRAWINGS

Figure 2:
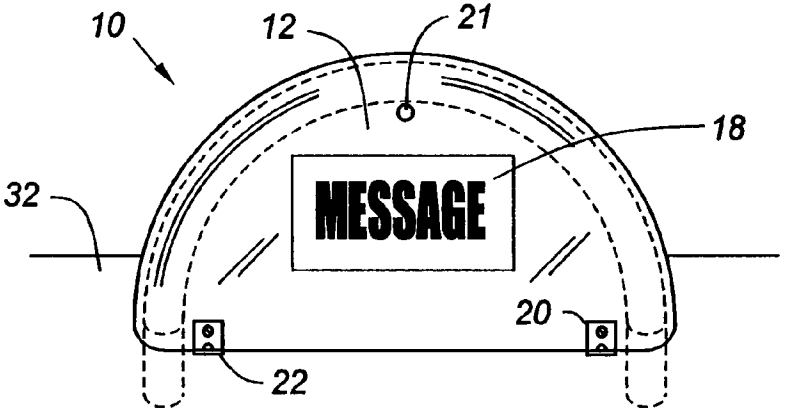
FIG. 2 is a perspective view of an installed barrier cover disposed with a fastening means.
Figure 3:
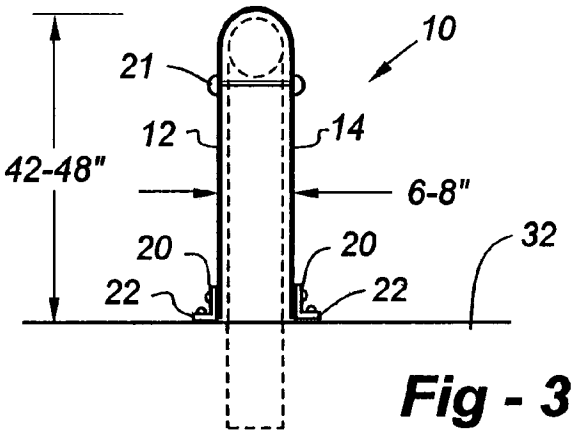
FIG. 3 is a side view of an installed barrier cover disposed with a fastening means.
Figure 1:
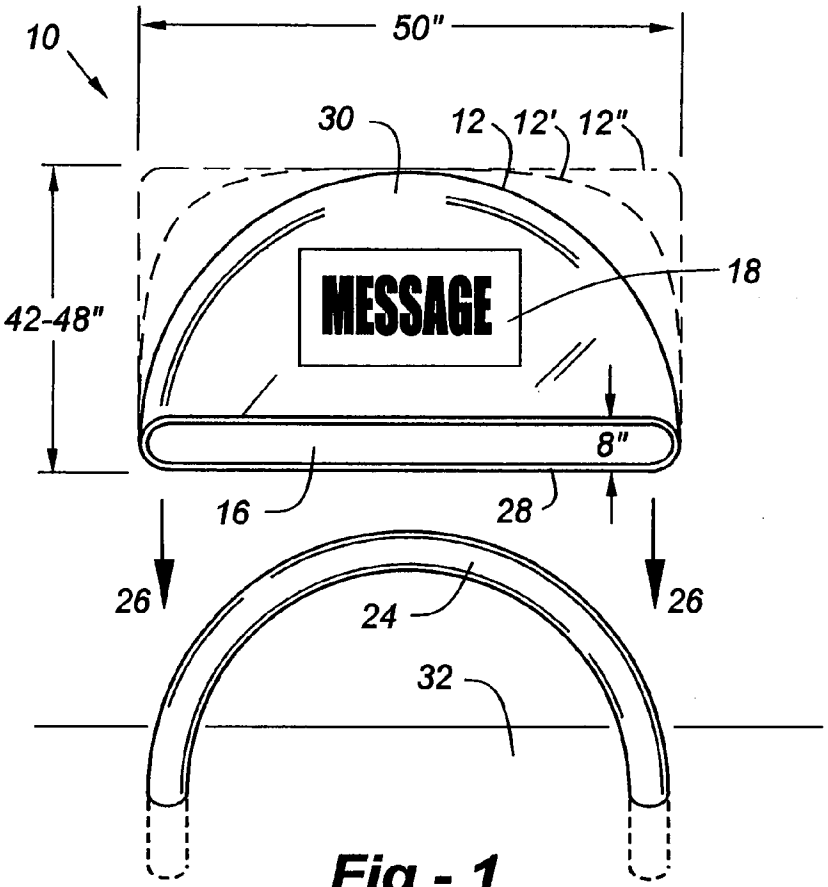
FIG. 1 is a perspective view of a protective barrier cover with an advertising means prior to fitting it to a barrier according to the invention.

A preferred embodiment of the protective barrier cover 10 is shown in FIGS. 1-3. FIG. 1 substantially shows the dimensions of the preferred embodiment of the barrier cover 10. The height of the post cover 10 shown is substantially 42 to 48 inches from the post cover vertex 30 to a point normal to the fixed surface 32. Referring to FIGS. 2 and 3, the post cover may be held in place with one or more fasteners 21 or other appropriate means such as an L-brackets 20 and screws 22. The body of the barrier cover 10 will preferably have an interior cavity 16 of substantially 6 to 8 inches in width, although it is recognized that other embodiments may have a width greater or less for an intended use. The width of the interior cavity remains generally constant from the bottom peripheral edge 28 of the barrier cover 10 to its vertex 30. The length of the interior cavity 16 decreases from substantially 50" at the bottom peripheral edge 28 to zero at the post cover vertex 30.

Referring again to FIG. 1, the barrier cover with advertising 10 is shown at a stage that precedes installation with a substantially semi-circular barrier post 24. To install, an installer would receive the barrier post 24 into the interior cavity 16 of the post cover 10 by slip fitting the post cover 10 onto the barrier post 24 as shown by the directional arrows 26. Referring to FIGS. 1 and 2, an advertising display 18 is shown disposed on a first elongated planar and semi-circular surface 12 but, alternatively (referring to FIG. 3), it can either be disposed on a second elongated planar and semi-circular surface 14, on both surfaces, or on the entire cover.

The preferred embodiment of the barrier cover 10 has a substantially semi-circular shape with an interior cavity 16 dimensioned to receive a generally semi-circular barrier post 24 in slip fit engagement. The cover 10 will generally be formed of a resilient, durable, and exposure resistant structural plastic that includes materials such as low-density polyethylenes and LEXAN brand polycarbonate. Also, as depicted by broken lines 12' and 12", the cover need not conform exactly to a circular barrier so long as partial slip-fit engagement is provided. The cover 10 is preferably molded using processes commonly known to those skilled in the art. As also known in the molding of plastics, various coloring agents may be mixed into the material of which the cover 10 is formed to provide a durable color throughout, and a variety of material enhancing additives may be used, including, but not limited to, additives to resist ultraviolet deterioration, or glow-in-the-dark phosphorescent materials, for example.

It should be understood that other illustrations or modifications to the present invention may be conceived by one skilled in the art which do not depart from the scope of the invention. The following claims will determine the breadth of protection afforded by law to the disclosed invention.

What is claimed is:

1. A display device comprising:

a tubular metal guard rail constructed from a bent pipe having a circular cross section with a diameter and two spaced-apart, below-ground ends resulting in a continuous, above-ground midsection with opposing side surfaces defining parallel planes, a cover having a rigid plastic sleeve with two parallel side panels having outer surfaces and inner surfaces spaced apart at a distance greater than the diameter of the pipe, the side panels being joined with a curved section resulting in an elongated bottom slot having a bottom edge defining a plane perpendicular to the plane of the side panels, the slot opening into an internal cavity dimensioned to fit over the guard rail with the bottom edge adjacent to a ground surface when the sleeve is installed over the midsection of the guard rail.

2. The display device of claim 1, wherein one or both of the outer surfaces includes an advertising display.

3. The display device of claim 2, wherein the advertising display is a message of stenciled letters.

4. The display device of claim 2, wherein the advertising display includes an electrical or electronic circuit comprising one or more lighting elements configured to display a message or image.

5. The display device of claim 2, wherein the advertising display includes one or more magnetically mounted objects of a ferro-magnetic surface.

6. The display device at claim 2, wherein the advertising display uses hook-and-loop materials.

7. The display device of claim 2, wherein the advertising display includes a chalkboard or marker surface.

8. The display device of claim 1, further including a fastener for securing the sleeve to the guard rail.

9. The display device of claim 1, further including a fastener for securing the sleeve to a ground surface.

* * * * *